US007650933B2

(12) United States Patent
Gilbert et al.

(10) Patent No.: US 7,650,933 B2
(45) Date of Patent: Jan. 26, 2010

(54) BAFFLE FOR SEALED COMBUSTION CHAMBER

(75) Inventors: George Glen Gilbert, Langley (CA); Howard Allen Larlee, Langley (CA)

(73) Assignee: Allied Engineering Company, division of E-Z-Rect Manufacturing Ltd., North Vancouver, British Columbia (CA)

( * ) Notice: Subject to any disclaimer, the term of this patent is extended or adjusted under 35 U.S.C. 154(b) by 881 days.

(21) Appl. No.: 11/078,374

(22) Filed: Mar. 14, 2005

(65) Prior Publication Data

US 2006/0201662 A1 Sep. 14, 2006

(51) Int. Cl.
*F28F 9/22* (2006.01)
*F25B 25/00* (2006.01)

(52) U.S. Cl. ..... 165/159; 122/235.17; 165/134.1

(58) Field of Classification Search ..... 165/159, 165/134.1, 181; 122/32, 33, 30.1, 31.1, 367.3, 122/367.1, 235.17, 44.2, DIG. 3, DIG. 13, 122/DIG. 6
See application file for complete search history.

(56) References Cited

U.S. PATENT DOCUMENTS 1,489,249 A * 4/1924 Hopwood ..... 249/65
2,856,905 A * 10/1958 Bowen, III ..... 122/236
3,616,849 A 11/1971 Dijt
4,721,068 A * 1/1988 Bassols et al. ..... 122/367.3
4,957,160 A * 9/1990 Raleigh ..... 165/160
5,697,435 A 12/1997 Stickford, Jr. et al.
6,267,066 B1 * 7/2001 Schickling et al. ..... 110/324
6,422,179 B2 * 7/2002 Hughes et al. ..... 122/18.31
2006/0194162 A1 * 8/2006 Pompe et al. ..... 431/354

OTHER PUBLICATIONS

"Installation and Operation Instructions for Mighty Therm Hydronic Boilers", 2003, Wateraterpik Technologies Inc., Moorpark, CA.
"Installation and Service Manual for Intelli-Fin Hot Water Heating Boilers", Lochinvar Corporation, Lebanon, TN.
"Raypak Replacement Parts Catalog No. 9300.35", Apr. 1, 2001, Raypak Inc., Oxnard, CA.
"Dominator Series finned copper gas boilers & water heaters Installation & Operation Manual", RBI Water Heaters, Westfield, MA.

* cited by examiner

*Primary Examiner*—Tho v Duong
(74) *Attorney, Agent, or Firm*—Oyen Wiggs Green & Mutala LLP

(57) ABSTRACT

A baffle for a heat exchanger tube extending between opposed header pipes. The baffle is a longitudinal member with a concave underside shape conforming to the convex circumferential shape of the heat exchanger tube, and has a length substantially equal to the distance between the header pipes. A lip having a convex top side shape conforming to the concave underside shape of the longitudinal member extends along one longitudinal edge of the member. Two such members can be nested together by overlaying the non-lipped longitudinal edge of a one member atop the lipped longitudinal edge of the other member. A plurality of longitudinally aligned heat vent slits extend substantially the entire length of an uppermost portion of the member.

17 Claims, 6 Drawing Sheets

BAFFLE FOR SEALED COMBUSTION CHAMBER

TECHNICAL FIELD

This invention relates to baffles for improving heat transfer in gas-fired hydronic boiler heat exchangers.

BACKGROUND

FIGS. 1 and 2 depict a prior art hydronic boiler 10 having a heat exchanger 12 incorporating upper and lower headers 14, 16. Upper header 14's finned heat exchange tubes 18 are fluidicly coupled between front and rear pipe portions of upper header 14. Lower header 16's finned heat exchange tubes 19 are fluidicly coupled between front and rear pipe portions of lower header 16. Riser pipes 20 fluidicly couple the rear pipe portions of upper and lower headers 14, 16 respectively.

Water to be heated is pumped into heat exchanger 12 via inlet pipe 22 which is fluidicly coupled to inlet port 23 provided in the front pipe portion of lower header 16. The water flows from inlet port 23 into the front pipe portion of lower header 16, then flows through one of finned tubes 19 to the rear pipe portion of lower header 16, then flows through one of riser pipes 20 to the rear pipe portion of upper header 14, then flows through one of finned tubes 18 to the front pipe portion of upper header 14, and ultimately exits heat exchanger 12 by flowing through an outlet port (not shown) provided in the front pipe portion of upper header 14.

Heat is provided by burner tubes 24 which burn natural gas or propane gas supplied to burner tubes 24 through gas manifold 26. Combustion air is drawn upwardly through apertured base pan 28 which is mounted beneath burner tubes 24. Hot gases emitted by burner tubes 24 flows between the heat exchange fins which spirally and circumferentially surround tubes 18, 19 thus heating the fins, tubes 18, 19 and the water flowing therethrough. Refractory insulation material 30 surrounds heat exchanger 12 and burner tubes 24. After flowing between the heat exchange fins of tubes 18, 19 as aforesaid, the hot gases are exhausted through flue collector nozzle 32.

Prior art baffles 34 are provided between the upper, longitudinally extending portions of each adjacent pair of finned tubes 18 or 19, and between each outermost finned tube 18 or 19 and the adjacent refractory insulation 30. Baffles 34 are typically metal bars having a "T" cross-sectional shape, a flattened "V" cross-sectional shape, or an arcuate "V" cross-sectional shape conforming to the outer curvature of finned tubes 18, 19. As depicted in FIGS. 1 and 2, baffles 34 have a "T" cross-sectional shape. Baffles 34 deflect hot gases emitted by burner tubes 24 toward finned tubes 18, 19 to improve heat transfer through finned tubes 18, 19 to water flowing therethrough. Without baffles 34, heat transfer efficiency is reduced, since a considerable portion of the hot gases emitted by burner tubes 24 escapes through finned tubes 18, 19 into flue collector nozzle 32 without contributing significantly to heating of finned tubes 18, 19 or water flowing therethrough.

This invention provides an improved baffle for enhancing the heat transfer efficiency of a gas-fired hydronic boiler heat exchanger.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
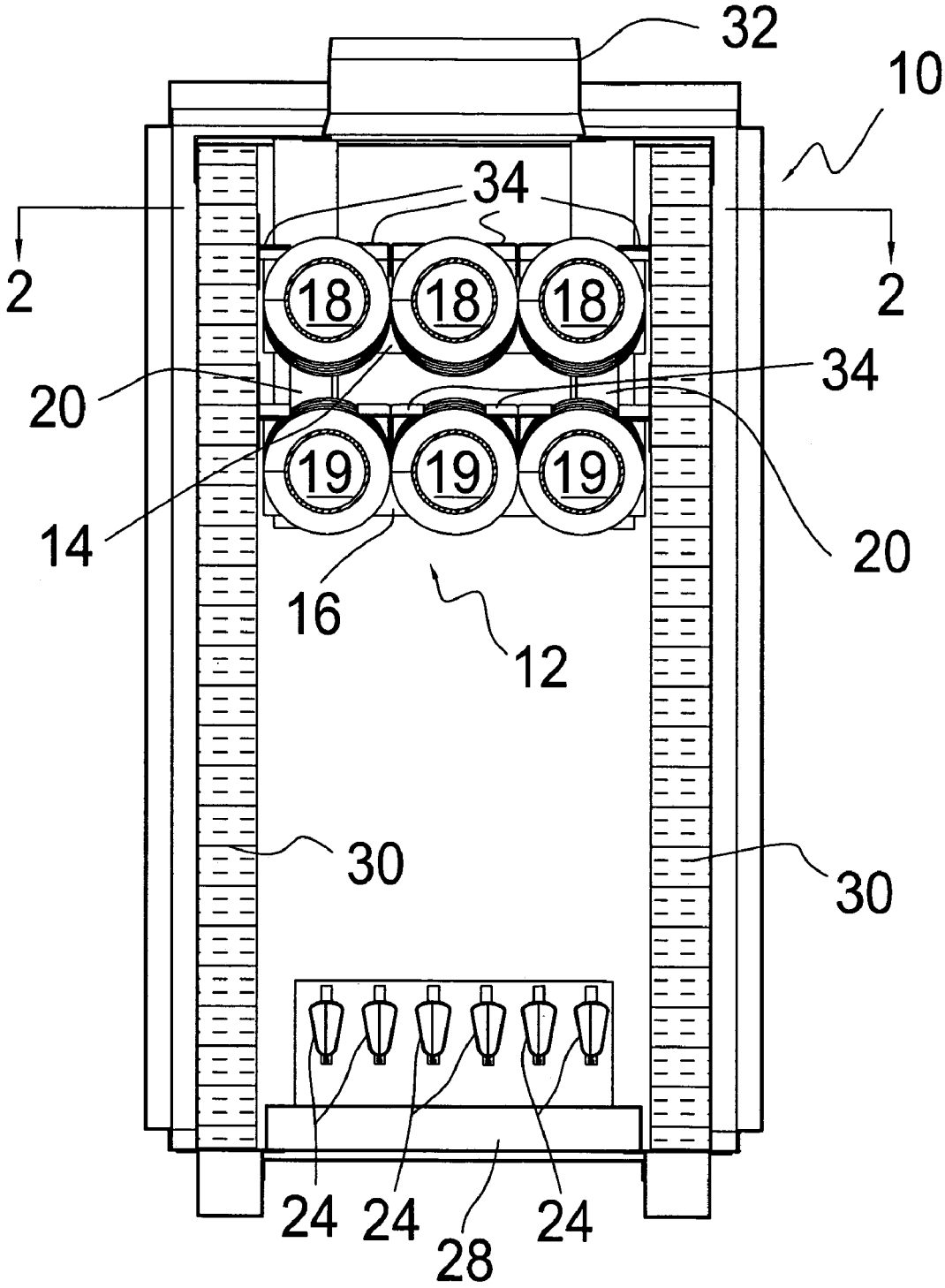
FIGURE 1 (PRIOR ART)
FIG. 1 is a cross-sectional front elevation view of a hydronic boiler having a heat exchanger equipped with prior art baffles.
Figure 2:
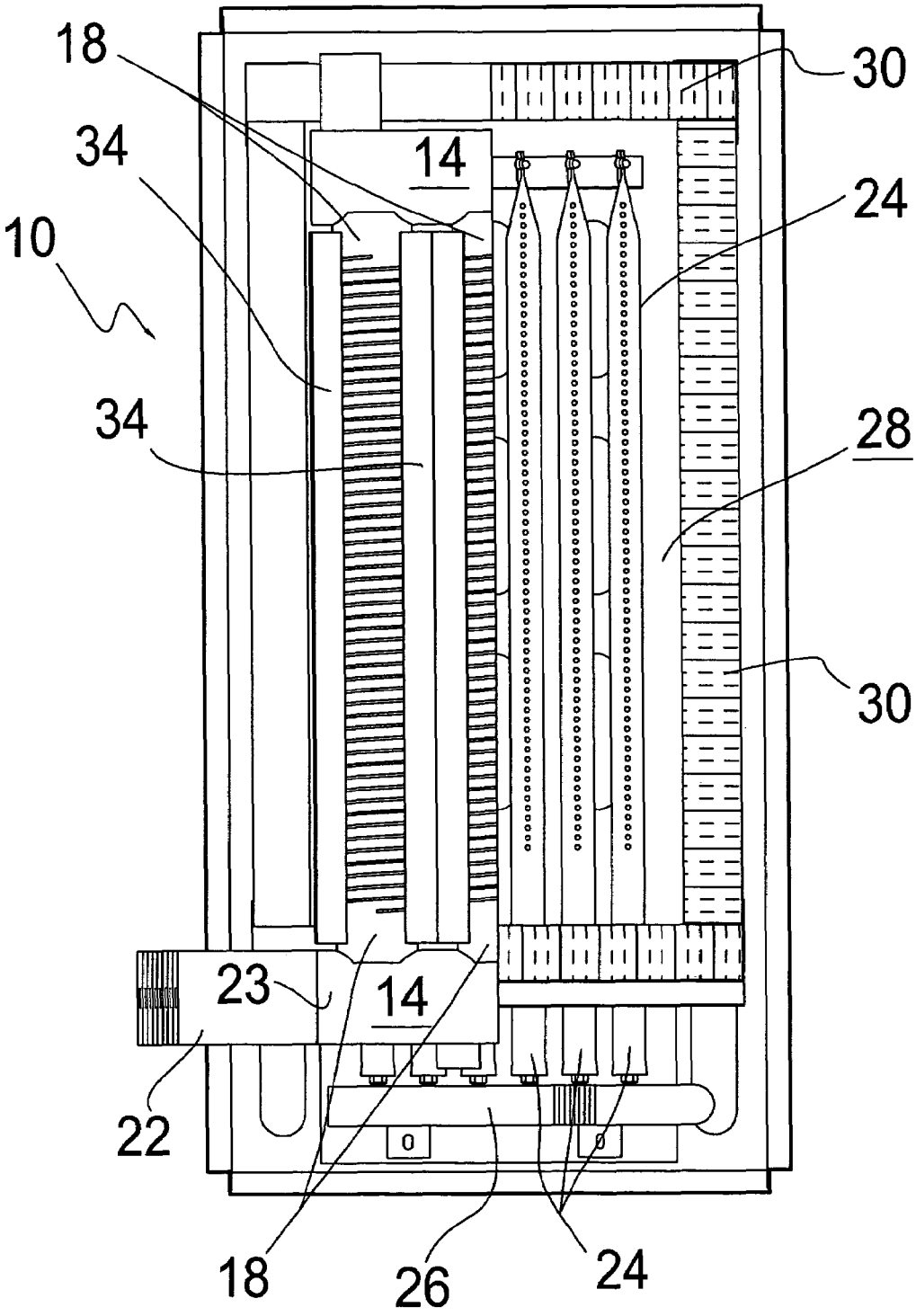
FIGURE 2 (PRIOR ART)
FIG. 2 is a partially fragmented cross-sectional top plan view of the FIG. 1 boiler, taken with respect to line 2-2 shown in FIG. 1.
Figure 3:
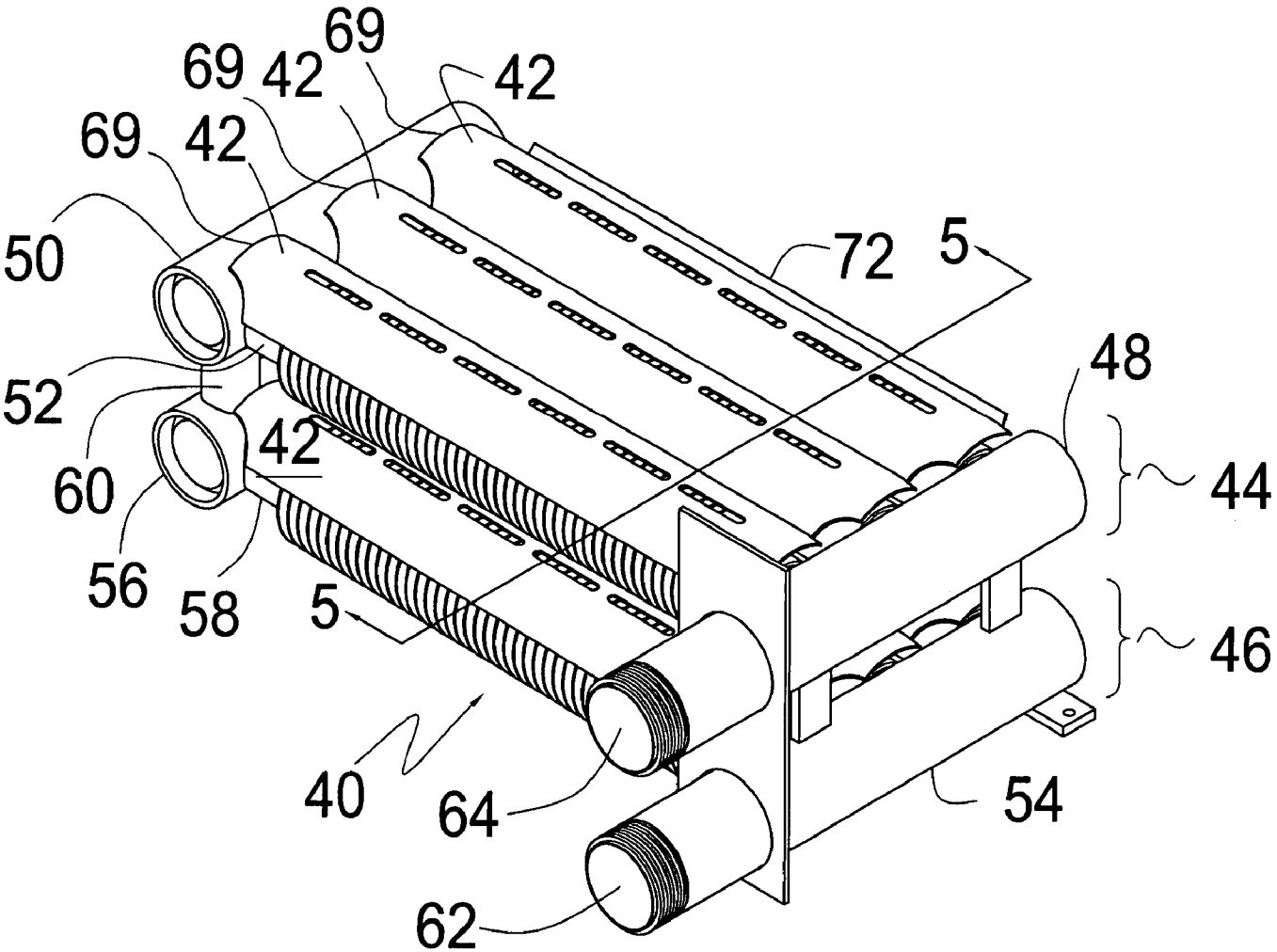
FIG. 3 is an oblique isometric view of a heat exchanger having a baffle in accordance with the invention.
Figure 4:
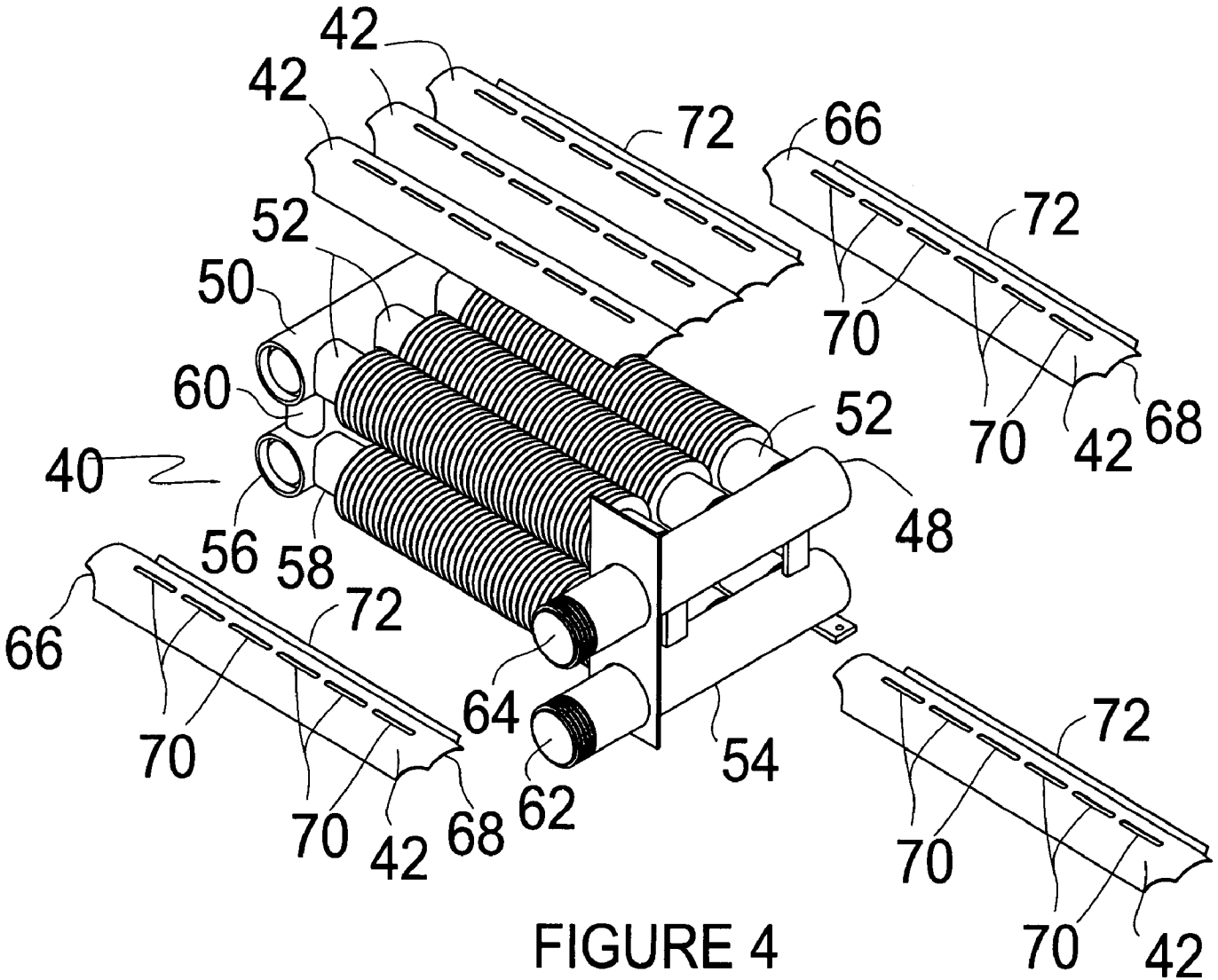
FIG. 4 is similar to FIG. 3, but is partially exploded to show the baffles apart from the heat exchanger, with the upper baffle's segments nested together and the lower baffle's segments separated from one another.
Figure 5:
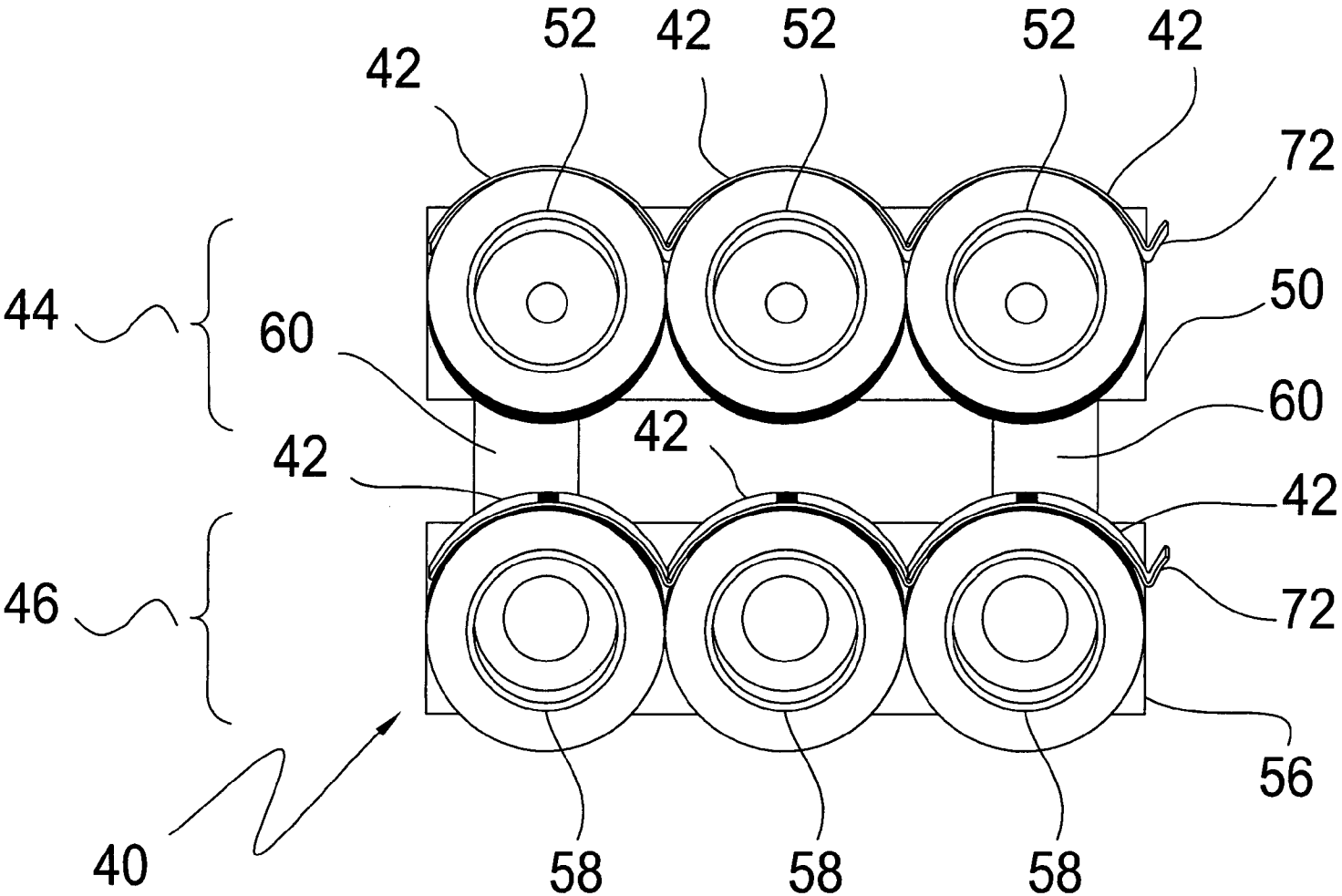
FIG. 5 is a cross-sectional view taken with respect to line 5-5 shown in FIG. 3.

FIGS. 3, 4 and 5 depict a heat exchanger 40 equipped with baffle segments 42 in accordance with the invention. Heat exchanger 40 incorporates upper and lower headers 44, 46. Upper header 44 incorporates front and rear pipes 48, 50 plus finned tubes 52 which are fluidicly coupled between pipes 48, 50. Lower header 46 incorporates front and rear pipes 54, 56 plus finned tubes 58 which are fluidicly coupled between pipes 54, 56. Riser pipes 60 fluidicly couple upper header rear pipe 50 and lower header rear pipe 56.

Water to be heated is pumped into heat exchanger 40 through lower header front pipe 54's inlet port 62. After flowing through lower header front pipe 54, one of finned tubes 58, lower header rear pipe 56, one of riser pipes 60, upper header rear pipe 50, one of upper header finned tubes 52 and upper header front pipe 48, the heated water exits heat exchanger 40 through upper header front pipe 48's outlet port 64.

A longitudinally extending baffle segment 42 is provided for each one of upper header 44's finned tubes 52 and for each one of lower header 46's finned tubes 58. Each baffle segment 42 is a longitudinal member having a concave underside shape conforming to the convex outer circumferential shape of the finned portion of finned tubes 52, 58. The longitudinally opposed ends of each baffle segment 42 are shaped to form arcuate tabs 66, 68 which are tightly fitted against the arcuate side one of header pipes 48, 50, 54, 56 during assembly of heat exchanger 40 such that the underside of each baffle segment 42 closely covers (e.g. touches) the upper circumferential portion of the heat exchange fins surrounding one of tubes 52, 58 and extends the entire length of that tube. One or more (preferably, a plurality of) longitudinally aligned heat vent slits 70 are formed through and extend along substantially the entire length of the uppermost portion of each baffle segment 42. A refractory ceramic fibre blanket such as that available from Unifrax Corporation of Niagara Falls, N.Y. under the trademark FIBERFRAX® is preferably fitted tightly over each one of header pipes 48, 50, 54, 56 and the adjacent portions of heat exchanger 40 to prevent hot gases from escaping through any gaps which may exist between the header pipes and the heat exchanger.

Figure 6:
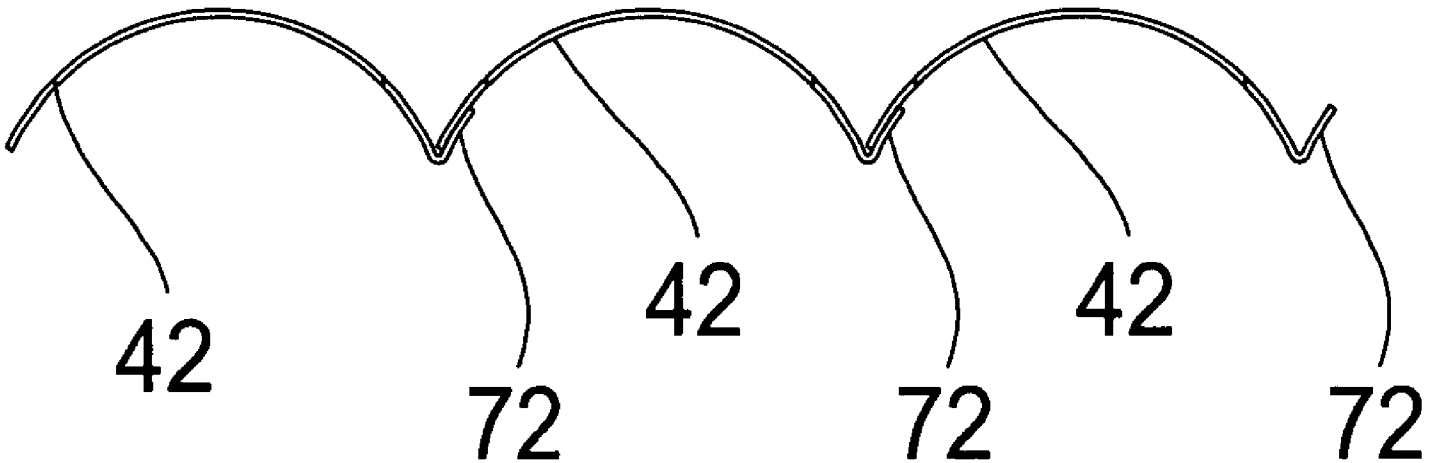
FIG. 6 is an end elevation view of three baffle segments nested together in accordance with the invention.

An upwardly protruding, longitudinally extending lip 72 is provided along one longitudinal edge of each baffle segment 42. As best seen in FIG. 6, the top side of each lip 72 has a convex shape conforming to the concave underside shape of each baffle segment 42. Lips 72 facilitate nesting of adjacent baffle segments 42 as best shown in FIGS. 5 and 6. More particularly, the non-lipped longitudinal edge of one baffle segment 42 is laid atop the lipped edge of an immediately adjacent baffle segment 42 to form a tight longitudinally extending seal between those two baffle segments. A plurality of baffle segments 42 can thus be nested tightly together, in close proximity above a corresponding plurality of adjacent heat exchange tubes 52 or 58.

Each baffle segment 42 covers about a 120° arc length semi-cylindrical portion of the uppermost part of one of finned tubes 52 or 58. Such semi-cylindrical covering concentrates the flow of hot combustion products (i.e. gases) against the adjacent finned tube 52 or 58, improving heat transfer efficiency in comparison to prior art baffles which do not cover the heat exchangers's finned tubes, or do not conform to the finned tubes' shape, or are placed further upstream or downstream of the finned tube. Such prior art baffles allow more hot combustion gases to bypass contact with the finned tubes' surfaces than baffle segments 42, or reduce the finned tubes' exposure time to the hot gases in comparison to the invention. Heat transfer efficiency is further improved if a plurality of baffle segments 42 are nested together as aforesaid. More particularly, when nested together as aforesaid, a plurality of baffle segments 42 promote more uniform flow of hot combustion gases past each one of finned tubes 52, 58 along the entire length of each baffle segment 42 and across the full width of each horizontal layer of finned tubes 52 or 58. Slits 70 controllably release hot gases after the gases have contributed significantly to heating of finned tubes 52 or 58 as aforesaid.

By contrast, time consuming labour is required to install prior art "T"-shaped or "V"-shaped baffles (or other prior art baffles) and align them precisely parallel to one another to achieve even combustion gas flow distribution along the length of each finned tube. Moreover, prior art baffles are typically wired in place. The wiring is usually destroyed by the combustion process, exposing the baffles to subsequent dislodgment and consequential misalignment due to heat warpage, or due to moving or jostling forces imposed on the boiler during maintenance operations. Even if prior art "T"-shaped or "V"-shaped baffles are correctly installed and aligned, the gaps left between adjacent baffles in each horizontal layer of finned tubes must be substantially equal to prevent excess flow of combustion gases (and consequential hot spots) at the widest gap. It is also difficult to achieve the desired uniform distribution of combustion gases with prior art baffles placed further upstream or downstream of the finned tube.

As will be apparent to those skilled in the art in the light of the foregoing disclosure, many alterations and modifications are possible in the practice of this invention without departing from the spirit or scope thereof. For example, the water flow path structure of heat exchanger 12 may differ somewhat from that of heat exchanger 40, but baffles 42 can be used with either one of heat exchangers 12 or 40 or with any other heat exchanger having finned heat exchange tubes like those provided in either of heat exchangers 12 or 40. As another example, lip 72 need not extend continuously along the entire longitudinal edge of baffle segment 42, but may be notched or divided to form a plurality of arcuate notches (not shown). Lip 72 also need not have an arcuate shape, but may be flat. Lips 72 may if desired be provided along both longitudinal edges of each baffle segment 42. As a further example, although each baffle segment 42 is preferably formed of thin material with a concave underside and a convex top side, baffle segments 42 could alternatively be formed of thicker material without a convex top side. The number and size of heat vent slits 70 may be increased or decreased, and the slits' shape may be varied as desired to accommodate fabrication techniques appropriate to the materials used to form baffle segments 42 and control combustion airflow. The scope of the invention is to be construed in accordance with the substance defined by the following claims.

What is claimed is:

1. A baffle for a heat exchanger tube extending between opposed header pipes, the baffle comprising first and second nestable longitudinal members each having a concave underside shape conforming to a convex circumferential shape of the heat exchanger tube and having a length substantially equal to the distance between the header pipes, the second longitudinal member further comprising a lipped longitudinal edge overlapping an adjacent longitudinal edge of the first longitudinal member to form a longitudinally extending seal between the first and second longitudinal members.

2. A baffle as defined in claim 1, further comprising a tab formed on each opposed end of each one of the longitudinal members, each tab sized and shaped for tight fitting engagement with one of the header pipes.

3. A baffle as defined in claim 2, each tab having an arcuate cross-sectional shape.

4. A baffle as defined in claim 1, further comprising at least one heat vent slit in each one of the longitudinal members.

5. A baffle as defined in claim 1, further comprising a plurality of heat vent slits in each one of the longitudinal members and wherein the heat vent slits are longitudinally aligned and extend substantially the entire length of the longitudinal members.

6. A baffle as defined in claim 5, wherein the heat vent slits extend along an uppermost portion of the longitudinal members.

7. A baffle as defined in claim 1, wherein the lipped longitudinal edge of the second longitudinal member has a convex top side shape conforming to the concave underside shape of the first longitudinal member.

8. A baffle as defined in claim 7, wherein the first longitudinal member further comprises a lipped longitudinal edge.

9. A baffle as defined in claim 7, wherein the first longitudinal edge of the first longitudinal member is non-lipped and overlies the lipped longitudinal edge of the second longitudinal member.

10. A baffle as defined in claim 8, wherein the first longitudinal edge of the first longitudinal member is non-lipped and overlies the lipped longitudinal edge of the second longitudinal member.

11. A hydronic heat exchanger having a baffle as defined in claim 1.

12. A hydronic heat exchanger having a baffle as defined in claim 9.

13. A hydronic heat exchanger having a baffle as defined in claim 10.

14. A hydronic boiler having a baffle as defined in claim 1.

15. A hydronic boiler having a baffle as defined in claim 9.

16. A hydronic boiler having a baffle as defined in claim 10.

17. A baffle for a heat exchanger tube extending between opposed header pipes, the baffle comprising a plurality of longitudinal members each having a length substantially equal to the distance between the header pipes, each longitudinal member comprising:

a concave underside surface conforming to a convex circumferential shape of the heat exchanger tube;

a non-lipped longitudinal edge; and a lipped longitudinal edge shaped to conform to and overlap with a non-lipped longitudinal edge of an adjacent longitudinal member to form a longitudinally extending seal between the adjacent longitudinal members.

* * * * *

UNITED STATES PATENT AND TRADEMARK OFFICE

CERTIFICATE OF CORRECTION

PATENT NO. : 7,650,933 B2
APPLICATION NO. : 11/078374
DATED : January 26, 2010
INVENTOR(S) : Gilbert et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1062 days.

Signed and Sealed this

Twenty-third Day of November, 2010

David J. Kappos

David J. Kappos
*Director of the United States Patent and Trademark Office*